US005493167A

United States Patent [19]

Mikol et al.

[11] Patent Number: 5,493,167

[45] Date of Patent: Feb. 20, 1996

[54] LAMP ASSEMBLY WITH SHROUD EMPLOYING INSULATOR SUPPORT STOPS

[75] Inventors: Dale K. Mikol, Brecksville; Martin N. Hassink, Macedonia, both of Ohio; Laszlo Dzsacsovszki, Budapest, Hungary

[73] Assignee: General Electric Company, Schenectady, N.Y.

[21] Appl. No.: 237,071

[22] Filed: May 3, 1994

[51] Int. Cl.[6] ..... H01J 1/02; H01J 1/88; H01J 1/46; H01J 17/16.18

[52] U.S. Cl. ..... 313/25; 313/292; 313/296; 313/634; 313/625

[58] Field of Search ..... 313/25, 292, 296, 313/634, 625

[56] References Cited

U.S. PATENT DOCUMENTS 4,499,396 2/1985 Fohl ..... 313/25

5,248,913 9/1993 Heider ..... 313/25

*Primary Examiner*—Sandra L. O'Shea
*Assistant Examiner*—John Ning
*Attorney, Agent, or Firm*—George E. Hawranko; Stanley C. Corwin

[57] ABSTRACT

A metal halide arc discharge lamp includes a sealed outer envelope, an arc tube located within the envelope, a cylindrical shroud positioned around the arc tube, stops positioned at ends of the shroud to capture the shroud therebetween, and conduction wires which both provide electrical energy to the arc tube and mechanically support the arc tube and the shroud. The outside diameter of the shroud is maximized in relation to the inside diameter of the neck of the outer envelope such that the shroud can be inserted through the neck during manufacture of said lamp. In order to reduce electrolytic sodium loss, a conductor wire passing through the shroud in close proximity to the arc tube is surrounded by a ceramic sleeve to electrically insulate the conductor wire from the arc tube, and the stops are ceramic to electrically insulate the shroud from the conductor wires.

22 Claims, 1 Drawing Sheet

LAMP ASSEMBLY WITH SHROUD EMPLOYING INSULATOR SUPPORT STOPS

BACKGROUND OF THE INVENTION

1. Field of the Invention

The present invention generally relates to electric lamp assemblies, and more particularly, to electric lamp assemblies having an improved structure for supporting a shroud.

2. Description of Related Art

Metal halide arc discharge lamps are frequently employed in commercial usage because of their high luminous efficacy and long life. A typical metal halide arc discharge lamp includes a quartz or fused silica lamp capsule or arc tube that is hermetically sealed within a borosilicate glass bulb or outer envelope. The arc tube, itself hermetically sealed, has tungsten electrodes press sealed in opposite ends and has a bulb portion containing fill material including mercury, metal halide additives, and a rare gas to facilitate starting. In some cases, both in low and high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud which comprises a generally cylindrical tube of light-transmissive material, such as quartz, that is able to withstand high operating temperatures. The arc tube and the shroud are coaxially mounted within the lamp outer envelope with the arc tube located within the shroud. The shroud improves the safety of the lamp by acting as a containment device in the event that the arc tube shatters. The shroud allows the lamp outer envelope to remain intact by dissipating the energy of a shattering arc tube. The presence of a shroud expands the market for metal halide lamps into open-type (absence of an expensive cover plate) lighting fixtures. The shroud can also be used for color correction of the discharge source. For such color correction, the shroud includes a wavelength selective reflector or absorber or phosphor, such as a multilayer titania-silica dichroic reflector.

Sodium is an important constituent in metal halide arc discharge lamps, usually in the form of sodium iodide. Sodium is used to improve the efficacy and color rendering properties. It has long been recognized that arc tubes containing sodium lose sodium during operation by movement or migration through the arc tube wall. The iodine originally present in a metal halide lamp as sodium iodide is freed by sodium loss, and the iodine combines with mercury in the arc tube to form mercury iodide. Mercury iodide leads to increased reignition voltages, thereby causing starting and lamp maintenance problems, and shortening lamp life.

There is evidence that most of the sodium loss is due to a negative charge on the arc tube walls caused by photoelectric emission from electrified side rods used to support the arc tube and shroud within the outer envelope. One solution to the problem has been various electrically insulated, isolated, or "floating" mounting supports attached or clipped to the outer surface of the shroud and the press seals of the arc tube in combination with a current return line for the outer end electrode of a fine molybdenum wire, known as a flying lead, spaced as far away from the arc tube as possible and hugging the curve in the outer bulb. For example see U.S. Pat. Nos. 5,270,608, 5,252,885, 5,136,204, 5,122,706, and 4,963,790 the disclosures of which are expressly incorporated herein in their entirety. While such lamp constructions provide an improvement, the elements located outside of the shroud limit the outer diameter of the shroud and thus constrain the physical size or wattage of the arc tube that can be used with a given outer envelope, the press seals of the arc tube must have tight manufacturing tolerances and are prone to damage during assembly, and the structures require a relatively high number of parts and welds.

SUMMARY OF THE INVENTION

The present invention provides an improved electric lamp assembly which solves the above noted problems found in prior art lamps. The lamp assembly is used in open-type lighting fixture applications wherein additional fixture containment shielding is not present. In accordance with the present invention, the improved lamp assembly includes a sealed light-transmissive lamp envelope having a dome region and a neck region sealed to a lamp stem. A pair of stem leads are sealed in and pass through the stem to the interior of the outer envelope. A light-transmissive shroud is disposed within the envelope and has an interior zone. A lamp capsule for generating light when electrical energy is applied thereto has a pair of electrical leads and a bulb portion with a first electrical lead end and a second electrical lead end. The bulb portion is located within the interior zone of the shroud. Means for electrically coupling the stem leads to the lamp capsule electrical leads are provided to supply electrical energy to the lamp capsule. The lamp also includes means for mechanically supporting the lamp capsule and the shroud. At least a portion of one of the means extends within the interior zone from an area adjacent the first electrical lead end to an area adjacent the second electrical lead end.

In accordance with a preferred embodiment, conduction wires attached to electrode leads are provided to both electrically couple and mechanically support the lamp capsule. A portion of a conduction wire within the shroud interior zone is shielded with an insulator sleeve made of a high temperature ceramic insulator such as an aluminum oxide ceramic. The insulator sleeve effectively minimizes sodium loss by decreasing the electrical field, and hence, sodium ion migration from the lamp capsule. The insulator sleeve also minimizes negative charged photoelectrons from being emitted from the conductor wire due to the effect of ultraviolet radiation. Thus, sodium loss is again minimized.

The improved lamp assembly of the present assembly eliminates mechanical and/or electrical transmission structure outside of the shroud so that the outer diameter of the shroud can be maximized thereby permitting physically larger, higher wattage lamp capsules or arc tubes to fit into the lamp envelope. Maximizing the outside diameter of the shroud also increases the containment ability of the shroud because fragments of a ruptured lamp capsule have decreasing velocities, and hence lower energy, before impact thereon and further allows the manufacturer to stock one diameter of shroud material for lamps of various wattages. Moreover, maximizing the outside diameter of the shroud improves the arc tube performance such as lumen maintenance and life because thermal effects of the shroud, particularly on the arc tube, are minimized. The need for tight manufacturing tolerances on the press seals is eliminated by supporting the lamp capsule independently of the shroud. Additionally, the potential breakage of the press seals during assembly is eliminated. The number of parts and welds required in this improved lamp assembly are reduced by both electrically coupling and mechanically supporting the arc tube utilizing only the conducting wires. A further result of the present invention is that the lamp capsule is totally contained within the axial length of the shroud to provide containment for both arc tube bulb rupture and arc tube press seal failure.

BRIEF DESCRIPTION OF THE DRAWINGS

These and other features and advantages of the present invention will be apparent with reference to the following description taken in conjunction with the accompanying drawings, wherein.

DETAILED DESCRIPTION OF THE PREFERRED EMBODIMENT

Figure 1:
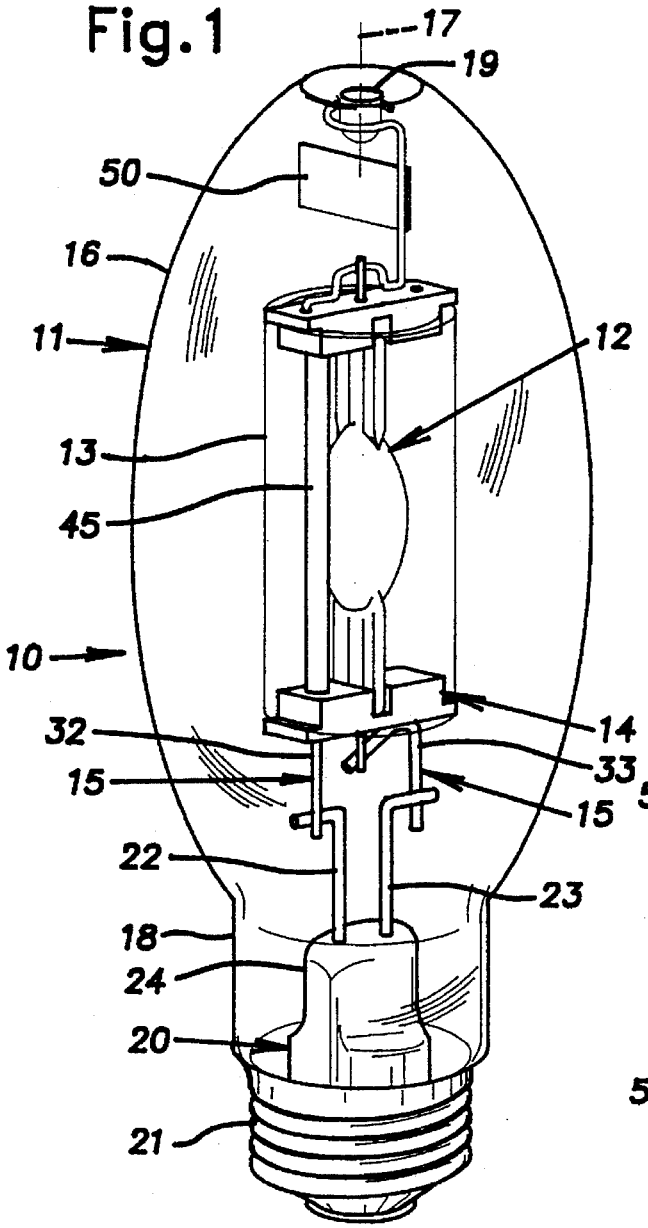
FIG. 1 is a perspective view of a lamp assembly in accordance with a preferred embodiment of the invention.

An electric lamp assembly 10 in accordance with a preferred embodiment of the invention is shown in FIG. 1. The lamp assembly 10 is a metal halide arc discharge lamp and includes a bulb or outer envelope 11, a lamp capsule or arc tube 12, a shroud 13, mechanical support means 14, and electrical coupling means 15. The outer envelope 11 has a main or dome region or portion 16 elongated along a central axis 17 and a neck region or portion 18. The dome portion can also be a cylindrical or tubular extension of the neck portion terminating in a rounded top. The dome portion 16 has a dimple 19 along the central axis 17 at the upper end of the outer envelope 11 (as viewed). The neck portion 18 has an inside diameter generally perpendicular to the central axis 17. The outer envelope 11 is typically formed of a blow molded hard glass such as borosilicate.

The outer envelope 11 is hermetically sealed with a glass stem 20 which extends into the neck portion 18 along the central axis 17. A base 21, formed for easy connection to an electrical source, is fixed to the outer envelope 11. A pair of electrical conductors or stem leads 22, 23 pass through the stem 20 and are sealed by a stem press 24 as is known in the art. The stem leads 22, 23 are electrically connected to the base 21 external of the outer envelope 11 to provide access for energization of the lamp.

Additionally, a zirconium aluminum getter 50 is positioned within and at the upper end of the outer envelope 11 (as viewed) generally adjacent the dimple 19. As is well known, getters are important in any structure wherein an evacuated or inert gas environment is desired.

Figure 2:
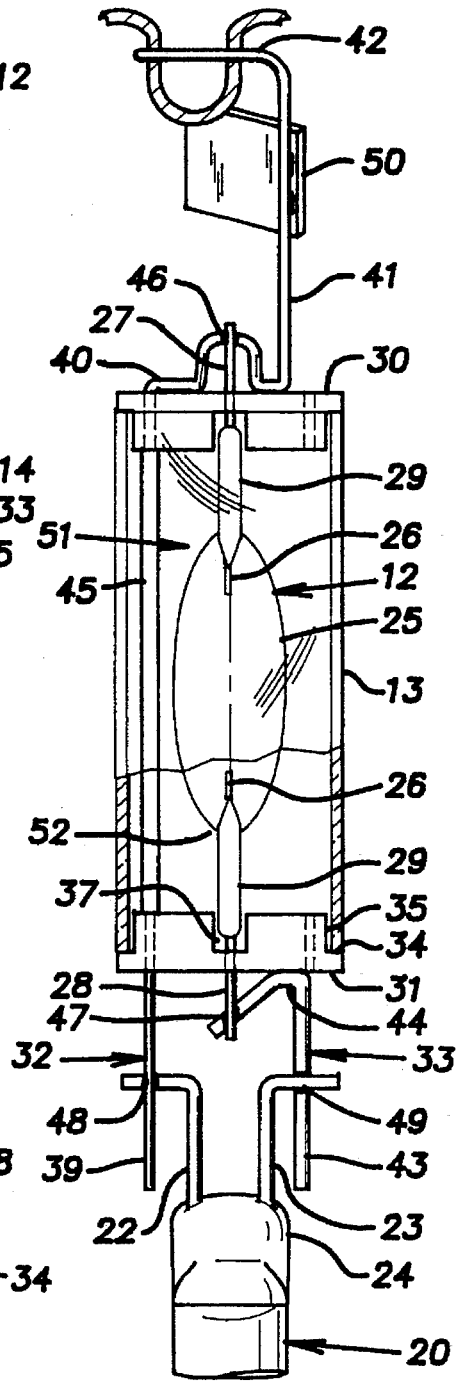
FIG. 2 is an enlarged elevational view, in partial cross section, of the arc tube, shroud, and support means of the lamp assembly of FIG. 1.

As best seen in FIG. 2, the arc tube 12 is disposed within the outer envelope 11 substantially parallel to the outer envelope central axis 17 and substantially within an interior space or cavity of the shroud 13. The arc tube 12 includes a bulb portion 25, two electrodes 26, a first or upper electrical or electrode lead 27, a second or lower electrical or electrode lead 28, and two pinch or press seals 29. It will be noted that in other types of lamp assemblies the lamp capsule is of a different configuration, for example, instead of two electrodes there may be a filament. The bulb portion 25 encloses a sealed discharge region which contains a suitable fill material for maintaining an arc discharge and is disposed within the interior cavity of the shroud 13. Preferably, the arc tube 12 is of an ellipsoidal design such as disclosed in U.S. Pat. No. 4,161,672 the disclosure of which is expressly incorporated herein in its entirety. The ellipsoidal design does not require the inside diameter of the shroud 13 to be in close proximity of the outside diameter of the arc tube 12 for suitable performance. Electrodes 26 are positioned at opposite ends of the discharge region. The press seals 29 are located at opposite first and second electrical or electrode ends of the bulb portion 25 and seal electrical or electrode leads 27, 28 to provide sealed electrical feed-throughs to the electrodes 26. It will be noted that the arc tube 12 of the preferred embodiment is a metal halide arc discharge lamp but can be a tungsten halogen incandescent lamp or other lamp which is advantageously operated with a shroud.

The shroud 13 is preferably a cylindrically-shaped tube having two ends which are open to an interior space, cavity or zone. Preferably, the shroud 13 is made of a light-transmissive and heat-resistant material such as quartz or glass. The shroud 13 is supported within the outer envelope 11 generally coaxial with the arc tube 12. The shroud 13 preferably has a length greater than the distance between the outer ends of the arc tube press seals 29 and less than the distance between the outer ends of the arc tube electrode leads 27, 28. The shroud 13 typically has a wall thickness of about 2.5 mm, and preferably between about 1.5 mm and about 2.5 mm. It is believed the shroud diameter can be further reduced to about 1.0 mm to decrease the volume of material required thus reducing cost and to further increase the distance between the shroud 13 and the arc tube 12. The shroud 13 must have an inner diameter greater than the outer diameter of the arc tube bulb portion 25 and preferably has a maximum outer diameter or an outer diameter only slightly less than the inner diameter of the outer envelope neck portion 18, that is, the shroud 13 has the generally largest outside diameter that can be conveniently inserted during manufacturing of the lamp assembly 10. Maximizing the outside diameter of the shroud 13 in relation to the neck portion 18 inside diameter increases the distance between the arc tube 12 and the shroud 13. This increased distance results in improved containment performance because fragments of a burst or ruptured arc tube 12 have lower velocities, and hence lower energy, as the distance from the arc tube 12 increases. Therefore, it is believed that the shroud 13 wall thickness can be reduced when the outer diameter is maximized and still be effective to contain fragments of a ruptured arc tube 12.

Means for supporting 14 the arc tube 12 and shroud 13 includes upper and lower insulator support stops or stops 30, 31, a first conductor wire 32, and a "j-frame" or second conductor wire 33. The support means 14 is preferably within the outer diameter of the shroud 13 as shown in FIG. 2, that is, it does not laterally extend beyond an infinite column defined by the outer diameter of the shroud 13. When the support means 14 does not laterally extend beyond, or is within, the outer diameter of the shroud 13, the outer diameter of the shroud 13 can be further maximized relative to the neck portion 18 of the outer envelope 11. As shown in FIG. 2, the effective portion of the support means 14 is within the outer diameter of the shroud 13. Any portion extending beyond the outer diameter of the shroud 13 and/or not providing support is preferably minimized.

Figure 3:
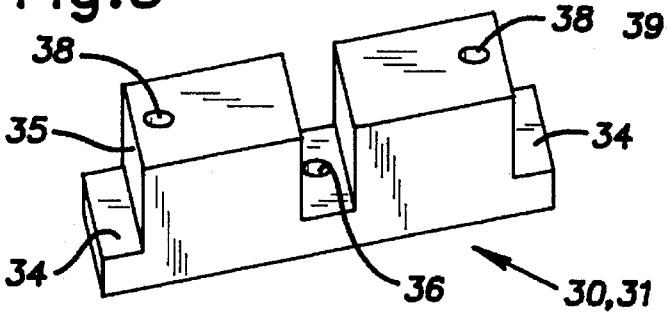
FIG. 3 is a perspective view of an insulator support stop.

As best seen in FIGS. 2 and 3 the stops 30, 31 are generally rectangularly shaped and have a notch or step at each end which forms an axially facing surface 34 and a laterally facing surface 35. The length of the stops 30, 31 is greater than the inside diameter of the shroud 13 and preferably less than the outside diameter of the shroud 13. The width of the stops 30, 31 is preferably sized such that the stops 30, 31 do not extend beyond the outside diameter of the shroud 13. It will be noted that a portion of the stops 30, 31 may extend beyond the outside diameter of the shroud 13, however, the portion of the stops 30, 31 effective to support or retain the shroud 13 is within the outside diameter of the shroud 13. The steps are sized such that a portion of each stop 30, 31 extends into the shroud 13 such that the laterally facing surfaces 35 limit lateral movement of the shroud 13 and radially position the shroud 13. Preferably there is a slight gap between the laterally facing surfaces 35 and the inside diameter surface of the shroud 13 to account for a tolerance in the inside diameter of the shroud. The stops 30, 31 are positioned at each end of the shroud 13 such that the axially facing surfaces 34 limit axial movement of the shroud 13 and the shroud 13 is captured or retained between the stops 30, 31. It will be noted that other stop geometries are possible such as, for example but not limited to, the stops could be generally circularly shaped, the stops could have an angled surface replacing the laterally facing and/or axially facing surfaces, or the stops could engage only the ends of the shroud 13.

Substantially at the center of each stop 30, 31 is an opening or centering hole 36 extending axially through the stop 30, 31 and sized for passage of the electrode leads 27, 28 of the arc tube 12. The centering holes 36 in the stops 30, 31 generally position or locate the arc tube 12 coaxially and laterally within the shroud 13. Each stop 30, 31 also contains a clearance slot 37 centered about the centering hole 36 to provide space for the thickness of the arc tube press seals 29 and to secure the stops 30, 31 generally perpendicular to the arc tube press seals 29. Inward from each end of the stops 30, 31 is an opening or outer hole 38 extending axially through the stops 30, 31 and sized for passage of the first conductor wire 32. By forming an outer hole 38 at each end of the stops 30, 31, the stops 30, 31 can be oriented in either lateral direction for ease of manufacturability. It is also noted that the upper and lower stops 30, 31 of the preferred embodiment are interchangeable.

The first conductor wire 32 has a first axial portion 39 generally parallel to the outer envelope central axis 17 that extends from one of the stem leads 22 through one of the holes 38 in the lower stop 31, the shroud 13, and one of the holes 38 in the upper stop 30. Upon exiting the upper stop 30, the first conductor wire 32 has a first lateral portion 40 extending past the upper electrode lead 27 and generally adjacent an outer surface of the upper stop 30, preferably configured to limit axial movement of upper stop 30. Preferably the first lateral portion 40 is bent away from the upper support stop 30 near the upper electrode lead 27. At the end of the first lateral portion 40 opposite the first axial portion 39 is a second axial portion 41. The second axial portion 41 extends to the upper end of the outer envelope 11 where a second lateral portion 42 generally encircles the dimple 19 of the outer envelope 11 to limit movement of the lamp capsule 12 and shroud 13 within the outer envelope 11 and improve rigidity of the entire assembly.

The second conductor wire 33 has an axial portion 43 generally parallel to the outer envelope central axis 17 that extends from the other stem lead 23 to the outer surface of the lower stop 31. At the lower stop 31 the second conductor wire 33 has a lateral portion 44 extending past the lower electrode lead 28 and having at least a portion against an outer surface of the lower stop 31 to limit axial movement thereof. Preferably the lateral portion 44 is bent away from the lower stop 31 adjacent the lower electrode lead 28. Forming the first and second conductor wires 32, 33 as described above enable the conductor wires 32, 33 to engage the outer surfaces of the stops 30, 31 to retain the shroud 13 therebetween.

The means for electrically coupling 15 the stem leads 22, 23 to the electrode leads 27, 28 includes the first and second conductor wires 32, 33. Preferably, at least a portion of the mechanical support means 14 electrically couples the stem leads 22, 23 to the electrode leads 27, 28. In the preferred embodiment, the first and second conductor wires 32, 33 act as both mechanical support means 14 and electrical coupling means 15. With this embodiment the number of parts and the number of welds is minimized.

As best shown in FIG. 2, the first conductor wire 32 extends through the interior zone of the shroud 13 adjacent the arc tube 12 from one of the shroud ends to the other of the shroud ends. It should be noted that the first conductor wire 32 extends through a critical area in close proximity to the arc tube 12, or within the interior zone of the shroud from an area adjacent the first electrical lead end, indicated in FIG. 2 by reference number 51, to an area adjacent the second electrical lead end, indicated by reference number 52. Thus, the first conductor wire 32 passes between the outer diameter of the arc tube bulb portion 25 and the inner diameter of the shroud 13 generally adjacent the arc tube bulb portion 25 or the arc tube discharge zone. As shown in FIG. 2, the first conductor wire 32 extends within the interior zone of the shroud 13 and is operative to couple one of the stem leads to the electrode lead 27.

Preferably, at least a central portion of the first conductor wire 32 passing through the shroud's interior zone generally adjacent or in close proximity to the bulb portion 25, as shown in FIG. 2, is surrounded by means for electrically insulating the first conductor wire 32. The insulating means effectively minimizes or reduces sodium loss from the arc tube 12 by decreasing the electric field, and hence, sodium ion migration from the arc tube 12. The insulating means also minimizes or reduces photoelectron effects or negative charged photoelectrons emitted from the first conductor wire 32 due to the effect of ultraviolet radiation. Thus, sodium loss is again minimized or reduced. The preferred method is to surround the first conductor wire 32 with an insulator sleeve 45. The insulator sleeve 45 is preferably made of a high temperature ceramic insulator such as an aluminum oxide ceramic. It is believed that other types of ceramic insulators such as forsterite and steatite may be utilized. It is also believed that the first conductor wire 32 could alternatively be coated with a dielectric material such as silicon nitride.

Additionally, means for electrically insulating or isolating the shroud 13 from the conduction wires 32, 33 is preferably provided. The shroud 13 is therefore not charged and the electrolytic sodium loss is reduced. Preferably, the stops 30, 31 are an electrically insulating material such as a high temperature ceramic. The stops of the preferred embodiment are of an aluminum oxide ceramic. It will be noted that the stops 30, 31 could include an electrically conductive material having ceramic bushings, inserts, or other insulating material at areas of contact with the electrical coupling means 15.

An arc tube 12 and shroud 13 subassembly or mount assembly is manufactured by first placing the upper stop 30 on the end of the shroud 13 and inserting the first conductor wire 32 through one of the outer holes 38 in the upper stop 30 until the first lateral portion 40 is generally adjacent the outer surface of the upper stop 30. The arc tube 12 is inserted into the shroud 13 such that the upper electrode lead 27 extends through the centering hole 36 of the upper stop 30. The insulator sleeve 45 is slid onto the first axial portion 39 of the first conductor wire 32. The lower stop 31 is placed on the lower end of the shroud 13 such that the lower electrode lead 28 extends through the centering hole 36 of the lower stop 31 and the first conductor wire 32 extends through the outer hole 38 of the lower stop 31. The arc tube 12 is generally centered along the axial length of the shroud 13 and the first electrode lead 27 is welded 46 to the first conductor wire 32 thus partially securing the shroud 13 in the axial direction. The lateral portion 44 of the second conductor wire 33 is placed adjacent the outer surface of the lower stop 31 and is welded 47 to the lower electrode lead 28 thus completely securing the shroud 13 in the axial direction. It will be noted that the stops 30, 31 do not contact the arc tube press seals 29, the arc tube 12 is held by the two welds 46, 47 to the electrode leads 27, 28. The first and second conductor wires 32, 33 are then welded 48, 49 to the stem leads 22, 23. The subassembly is thereafter inserted into the outer envelop 11 through the inner diameter of the neck portion 18 and sealed to the outer envelope 11.

Although a particular embodiment of the invention has been described in detail, it will be understood that the invention is not limited correspondingly in scope, but includes all changes and modifications coming within the spirit and terms of the claims appended hereto.

What is claimed is:

1. An electric lamp assembly comprising:

a sealed light-transmissive lamp envelope having a dome region and a neck region sealed to a lamp stem, said lamp stem having a pair of stem leads sealed therein and passing therethrough;

a light-transmissive shroud disposed within said envelope and having an interior zone;

a lamp capsule for generating light when electrical energy is applied thereto and having a pair of electrical leads and a bulb portion, said bulb portion located within said interior zone of said shroud; means for mechanically supporting said lamp capsule and said shroud within said envelope; and means for electrically coupling said stem leads to said lamp capsule electrical leads, wherein sat least a portion of said coupling means extends within said interior zone of said shroud laterally adjacent said bulb portion.

2. The lamp according to claim 1, wherein said shroud has two open ends and at least a portion of said coupling means longitudinally extends within said interior zone of said shroud from one of said shroud ends to the other of said shroud ends.

3. The lamp according to claim 1, wherein said shroud has an outer diameter and all effective portions of said support means are within said outer diameter.

4. The lamp according to claim 3, wherein said shroud has a maximum outer diameter maximized in relation to an inside diameter of said neck region.

5. The lamp according to claim 1, wherein said shroud has two opposed ends and said support means includes a stop at each of said ends of said shroud engaging end surfaces of said shroud to contain said shroud therebetween.

6. The lamp according to claim 5, wherein each of said stops has a step at outer portions of said stops, said step forming an axially facing surface engaging said end surfaces of said shroud to axially support said shroud and a laterally facing surface engaging a side surface of shroud to radially position said shroud.

7. A metal halide arc discharge lamp comprising:

a sealed light-transmissive lamp envelope having a dome region and a neck region sealed to a lamp stem, said lamp stem having a pair of stem leads sealed therein and passing therethrough;

a light-transmissive shroud disposed within said envelope and having an interior zone;

an arc tube containing a chemical fill including a metal halide for generating light when electrical energy is applied thereto and having first and second electrode leads and a bulb portion located within said interior zone;

means for mechanically supporting said arc tube and said shroud within said envelope, and means for electrically coupling said stem leads to said first and second electrode leads, wherein at least a portion of said coupling means extends within said interior zone of said shroud laterally adjacent said bulb portion.

8. The lamp according to claim 7, wherein said shroud has two open ends and at least a portion of said coupling means longitudinally extends within said interior zone of said shroud from one of said shroud ends to the other of said shroud ends.

9. The lamp according to claim 7, wherein at least a portion of said coupling means mechanically supports said shroud.

10. The lamp according to claim 7, wherein said first electrode lead is at an end of said arc tube opposite said lamp stem and said second electrode lead is at an end of said arc tube adjacent said lamp stem, and said coupling means includes a first conductor wire extending through said interior zone from a first open end of said shroud to a second open end of said shroud and operative to couple one of said stem leads to said first electrode lead.

11. The lamp according to claim 10, wherein a portion of said first conductor wire within said interior zone and adjacent said bulb portion is surrounded by means for electrically insulating said first conductor wire to reduce sodium loss from the bulb portion.

12. The lamp according to claim 11, wherein said insulating means is an aluminum oxide ceramic sleeve.

13. The lamp according to claim 7, wherein said shroud has an outer diameter and all effective portions of said supporting means are within said outer diameter.

14. The lamp according to claim 13, wherein said shroud has a maximum outer diameter maximized in relation to an inside diameter of said neck region.

15. The lamp according to claim 7, wherein said shroud has two opposed ends and said support means includes a stop at each of said ends of said shroud, said stops engaging end surfaces of said shroud to contain said shroud therebetween.

16. The lamp according to claim 15, wherein each of said stops has a step at outer portions of said stops, said step forming an axially facing surface engaging said end surfaces of said shroud to axially support said shroud and a laterally facing surface engaging a side surface of shroud to radially position said shroud.

17. The lamp according to claim 15, wherein said stops electrically insulate said shroud from said coupling means.

18. The lamp according to claim 15, wherein each of said stops has an opening generally at the center of said stop, said first electrode lead extending through said opening in one of said stops and said second electrode lead extending through said opening in the other of said stops to generally center said arc tube within said shroud.

19. The lamp according to claim 15, wherein each of said stops has an opening at an outer portion of said stop and a first conductor wire extends through each of said openings.

20. The lamp according to claim 15, wherein said first electrode lead is at an end of said arc tube opposite said lamp stem and said second electrode lead is at an end of said arc tube adjacent said lamp stem, said coupling means including a first conductor wire extending within said interior zone and operative to couple one of said stem leads to said first electrode lead and a second conductor wire coupling the other of said stem leads to said second electrode lead, said first and second conductor wires effectively engaging said stops to retain said shroud therebetween.

21. The lamp according to claim 20, wherein at least a portion of said first conductor wire is surrounded by an insulating sleeve, and said stops electrically insulate said shroud from said first and second conductor wires.

22. The lamp according to claim 21, wherein said shroud has a maximum outer diameter maximized in relation to an inside diameter of said neck region.

* * * * *